US007188452B2

(12) United States Patent
Sridhara

(10) Patent No.: US 7,188,452 B2
(45) Date of Patent: Mar. 13, 2007

(54) SLEEVED BRACING USEFUL IN THE CONSTRUCTION OF EARTHQUAKE RESISTANT STRUCTURES

(76) Inventor: Benne Narasimha Murthy Sridhara, 66, H.B.Samaja Road, Basavanagudi, Bangalore - 560004 (IN)

( * ) Notice: Subject to any disclaimer, the term of this patent is extended or adjusted under 35 U.S.C. 154(b) by 0 days.

(21) Appl. No.: 10/387,144

(22) Filed: Mar. 11, 2003

(65) Prior Publication Data

US 2003/0205008 A1 Nov. 6, 2003

Related U.S. Application Data

(63) Continuation-in-part of application No. PCT/IN00/00087, filed on Sep. 12, 2000.

(51) Int. Cl.
*E04B 1/98* (2006.01)
*E04H 9/02* (2006.01)

(52) U.S. Cl. ..... 52/167.3; 52/1; 52/167.2; 52/167.4; 52/167.8; 52/737.4; 52/738.1; 52/739.1; 188/266; 267/140.13; 267/141.5

(58) Field of Classification Search ..... 52/1, 52/167.1, 167.2, 167.3, 167.4, 167.8, 738.1, 52/739.1, 737.4; 188/266; 267/136, 140.12, 267/140.13, 141.4–141
See application file for complete search history.

(56) References Cited

U.S. PATENT DOCUMENTS

| | | | | | |
|---|---|---|---|---|---|
| 901,453 | A * | 10/1908 | Lally | 52/283 |
| 3,418,768 | A * | 12/1968 | Cardan | |
| 3,528,312 | A * | 9/1970 | Nielsen | 74/502.5 |
| 4,582,303 | A * | 4/1986 | Taylor | 267/64.13 |
| 4,815,574 | A * | 3/1989 | Taylor et al. | 188/280 |
| 4,867,286 | A * | 9/1989 | Taylor | 188/282 |
| 5,107,634 | A * | 4/1992 | Onoda et al. | 52/1 |
| 5,158,270 | A * | 10/1992 | Lin | 267/226 |
| 5,175,972 | A * | 1/1993 | Sridhara | 52/737.4 |
| 5,462,141 | A * | 10/1995 | Taylor | 188/280 |
| 5,491,938 | A * | 2/1996 | Niwa et al. | 52/167.1 |
| 5,727,663 | A | 3/1998 | Taylor | |
| 5,833,038 | A * | 11/1998 | Sheiba | 188/378 |
| 5,934,028 | A * | 8/1999 | Taylor | 52/167.3 |
| 6,244,577 | B1 * | 6/2001 | Bucholtz | 267/136 |
| 6,530,182 | B2 * | 3/2003 | Fanucci et al. | 52/167.3 |
| 6,648,295 | B2 * | 11/2003 | Herren et al. | 248/636 |
| 6,701,680 | B2 * | 3/2004 | Fanucci et al. | 52/167.3 |

FOREIGN PATENT DOCUMENTS

JP 3-247870 * 1/1991

OTHER PUBLICATIONS

International Search Report dated Jul. 2, 2001.

* cited by examiner

*Primary Examiner*—Carl D. Friedman
*Assistant Examiner*—Yvonne M. Horton
(74) *Attorney, Agent, or Firm*—TraskBritt

(57) ABSTRACT

A buckling restrained brace includes an elongate, hollow sleeve, an elongate yielding core extending substantially through the length of the sleeve, and a buckling constraining element between the yielding core and the inner surface of the hollow sleeve and spaced apart from at least one surface of the yielding core, leaving a gap therebetween. The buckling constraining element may be spaced apart from and, thus, the gap may exist between two or more surfaces of the yielding core. Additionally, an inner sleeve, or liner, may be positioned between the buckling constraining element and the yielding core, with the liner being spaced apart from at least one surface of the yielding core. The buckling restrained brace is useful in absorbing loads, such as seismically induced loads, that are exerted upon a steel frame.

45 Claims, 17 Drawing Sheets

A–A

B–B

B1–B1

D–D

E–E

F–F

G–G

H–H

I–I

J–J

K–K

L–L

M-M

L-L

P–P

N–N

SLEEVED BRACING USEFUL IN THE CONSTRUCTION OF EARTHQUAKE RESISTANT STRUCTURES

CROSS-REFERENCE TO RELATED APPLICATIONS

This application is a continuation-in-part of PCT/IN00/00087, with an international filing date of Sep. 12, 2000, for which the U.S. is a designated state.

BACKGROUND OF RELATED ART

1. Field of the Invention

The present invention relates generally to sleeved braces, or "buckling restrained braces," and methods for manufacturing the same. More specifically, the present invention relates to buckling restrained braces that include yielding core members that extend through an outer sleeve which contains a buckling constraining material, which yielding core members are laterally spaced apart from the buckling constraining material by way of an air gap. Among other purposes, the buckling restrained braces of the present invention are useful in the construction of earthquake resistant structures, such as earthquake resistant steel building frames.

2. Background of Related Art

In order to understand the importance of the buckling restrained braces of the present invention, it is beneficial to briefly describe the nature of the forces that act on a building or other structure during an earthquake.

During an earthquake, the ground on which a building or other structure is built or by which the building or other structure is supported is subjected to a variety of primary vibratory motions, including vertical motion (i.e., up and down motion), lateral drift, inverted pendulum movement in one or more vertical planes, and plan rotation.

With reference to FIG. 1*a*, the framework of a typical multistory building, which comprises beams and columns, is shown. During the up and down vibratory motion of the ground, the whole building moves up with a vertical acceleration, as shown in FIG. 1*b*, and then, after reaching a peak, will move downward with a vertical acceleration as shown in FIG. 1*c*. This motion repeats during the duration of the earthquake. As the ground moves up and down, so does the building and its framework. Due to its mass, as the building accelerates vertically, its framework is subjected to additional vertical loads, depending on the direction of motion, as shown by the arrows in FIGS. 1*b* and 1*c*. The beams and columns of the framework of the building can be designed easily to withstand these additional vertical loads.

As the ground drifts laterally, the whole building will move laterally, with acceleration to one side, as shown in FIG. 1*d*, and, after reaching a peak value of drift, will move in the opposite direction, as shown in FIG. 1*e*. Because of the mass of the building and the lateral acceleration, the building frame will be subjected to cyclical lateral loads F1, F2, and F3, as shown by the arrows in FIG. 1*d* and FIG. 1*e*. These lateral loads may result in severe damage to the framework of the building. Conventionally, to counteract lateral loads, complex framework designs have been developed, their complexity making them somewhat undesirable and often increasing the costs associated with erecting the framework of the building.

Inverted pendulum motion of the ground causes the entire framework of a building and, thus, the entire building, to rotate in a vertical plane with an angular acceleration. Once a peak value of rotation has been reached, the building and its framework will rotate in the reverse direction. During such angular acceleration, and due to the mass of the building, the building frame will be subjected to additional cyclical lateral loads F1, F2, and F3, as shown by the arrows in FIG. 1*f* and FIG. 1*g*.

During plan rotation of the ground, the building will rotate in plan with an angular acceleration and, after reaching a peak rotation, will rotate in the reverse direction. Because of the mass of the building and the angular acceleration, lateral forces will act on the frame, as shown by the arrows in FIGS. 1*h* and 1*i*.

Many design procedures are available to design the building framework that can withstand these earthquake-induced additional lateral loads. In this context, it is mentioned that many codes of practice in the United States recommend that the building framework remain elastic, or nearly so, under moderate earthquakes of frequent occurrence, but be able to yield locally without serious consequences during major earthquakes.

Many types of structural frame configurations and designs that are intended to resist earthquake-induced loads are presently available.

For example FIG. 2*a* shows a normal building frame comprising beams 1 and columns 2. The beams 1 are supported on seating cleats 3 that are located on and secured to the columns 2. The columns 2, in turn, are supported on base plates 4. By avoiding the inclusion of diagonal members, each opening, or "bay," between adjacent pairs of beams 1 and columns 2 readily accommodates doors, windows, service ducts, and the like. Without diagonal members, however, when subjected to earthquake (i.e., seismic) or other loads, the frame undergo excessive lateral sway, or drift, as shown in FIG. 2*b*, when lateral forces F1, F2, and F3 act thereon. In order to counteract loads and, thus, reduce or prevent such excessive lateral sway, the connections between the beams 1 and columns 2 are made rigid.

FIG. 3*a* shows a rigid frame design which includes beams 5, columns 6, stiffeners 7 positioned proximate the junction of each beam 5 with a column 6, and base plates 8 located at the bottom ends of columns 6. The end of beam 5 is connected to the flange of column 6 by a full-strength weld. Stiffeners 7 are welded to the column 6 to prevent the flange of each column 6 from bending outwardly. Additionally, a plastic hinge may be positioned adjacent to each beam 5-to-column 6 junction. FIG. 3*b* shows an enlarged view of the rigid connection between a beam 5 and a column 6 of the rigid frame design of FIG. 3*a*. FIG. 3*c* is a cross-sectional representation taken along line A—A of FIG. 3*b*.

This configuration of moment-resisting frame is able to resist the lateral forces F1, F2, and F3 and exhibits low stiffness and high ductility, which are desirable features in earthquake-resistant structural systems. FIG. 3*d* shows the deflected shape of the frame when subjected to earthquake-induced lateral forces F1, F2, and F3. When the frame is subjected to an earthquake-induced load, some of the energy is dissipated at the plastic hinge. Frequently, this system suffers severe drift as well as premature failure at the beam 5-to-column 6 connections, which may render it non-functional even after moderate earthquakes. Further, this system is not viable for tall buildings.

FIG. 4*a* shows a frame with concentric "tension only" intersecting diagonal bracings 12 and 13. The frame includes columns 11, beams 10, and diagonal bracings 12 and 13. The diagonal bracings 12 extend in the direction labeled as "X." The diagonal bracings 13 extend in the direction labeled as "Y." The diagonal bracings 12 and 13 typically include rolled steel angle sections. The diagonal bracings 12 and 13 cross each other and, hence, are also referred to as "intersecting diagonals," which are arranged as an "X" in each bay formed by adjacent pairs of columns 11 and beams 10. A base plate 17 is positioned at the bottom, or base, of each column 10. An end plate 14 is welded to the end of each beam 10 and, thus, abuts the column 11 when the beam 10 is positioned adjacent thereto. Gusset plate 15, 16 are secured at the junctions between each column 11 and beam 10 to facilitate the securing of a diagonal bracing 13, 12, respectively, to the remainder of the frame. In actual practice, the gusset plates 15 may have a different size than gusset plates 16, which sizes depend on the force in the diagonal bracing 13, 12, respectively, to be secured thereto.

FIG. 4*b* shows the joint between each column 11, beam 10, end plate 14, diagonal bracing 12, 13, and gusset plate 15, 16. Again, the beam 10 has an end plate 14 welded to an end thereof. The end plate 14 has holes to facilitate connection thereof and, thus, of the beam 10, to the column 11. The flange of the column 11 has matching holes for connecting to end plate 14. Gusset plates 15, 16 are welded to both a beam 10 and an end plate 14. Diagonal bracings 13, 12 are respectively secured to the gusset plates 15, 16 by bolts. In this connection, the centerlines of column 11, beam 10, and diagonal bracings meet at point "a" and, hence, the bracing is referred to as "concentric." In this design, the tension diagonals 12 and 13 are very slender and can resist tension well, but buckle under even little compressive force.

As shown in FIG. 4*c*, F1, F2, and F3 represent earthquake-induced lateral loads that act on the frame at different floor levels. When earthquake induced lateral forces F1, F2, and F3 act at each floor level of the frame in the direction of the arrows, as shown in FIG. 4*c*, the frame will deflect laterally, as shown, and the diagonal bracings 12 will be subjected tension, while the diagonal bracings 13 will buckle under slight compressive force. When the direction of loading reverses, as shown in FIG. 4*d*, diagonal bracing 13 will be in tension and diagonal bracing 12 will buckle and become ineffective, as shown.

This system resists the earthquake induced lateral loads very effectively because of the presence of diagonals in the framework. The connection details are also quite simple. If, during a severe earthquake, the tension in the diagonal bracings 12, 13 exceeds their yield strength, they enter a plastic state and absorb shock energy well. However, they will become permanently elongated. Under repeated cyclic loading, both the diagonal bracings 12 and 13 undergo larger permanent elongation and, as a result, the structure degrades. Once the structure degrades, the lateral drift of the frame will be beyond acceptable limits, even in minor earthquakes.

A frame that includes diagonal bracing which is configured to absorb both tension and compression is shown in FIGS. 5*a*–5*d*. Such a frame includes beams 18, columns 19, diagonal bracing 20, and end plate 21 at the end of each beam 18, and a gusset plate 22 secured to a beam 18 and an end plate 21 at the junction between that beam 18 and a column 19. In addition, a base plate 23 is secured to the bottom, or base, of each column 19.

The junction between a beam 18, column 19, and diagonal bracing 20 is shown in FIG. 5*b*. The centerlines of beam 18, column 19, and diagonal bracing 20 meet at point "g" and, hence, the bracing is said to be "concentric."

As depicted in FIG. 5*c*, when lateral loads F1, F2, and F3 are exerted on the frame in the directions of the arrows, the diagonal bracing 20 will be compressed. When the direction of loading reverses, as shown in FIG. 5*d*, the same diagonals will be in tension.

In such a brace design, when a diagonal bracing 20 is in tension, it will undergo plastic deformation when subjected to load beyond its yield strength and absorb shock energy. However, when the same diagonal bracing 20 is compressed, it will buckle at a far lesser load without absorbing any shock energy. In order to prevent premature buckling, it is necessary to increase the stiffness of each diagonal bracing 20 by adopting a much larger structural section. This makes the diagonal bracing 20 very heavy and expensive. Although the lateral drift of a building including such a frame is significantly reduced, providing a very stiff diagonal bracing increases the total stiffness of the frame which, in turn, generates larger lateral shears (loads) at the foundation level of the building, which is not desirable. Also, when the diagonal bracings 20 are subjected to a compressive force beyond their yield strengths, they will buckle suddenly without absorbing much energy.

The so-called "eccentric bracing system," illustrated in FIG. 6, is a design which improves upon the preceding frame designs and which has been extensively adopted across the world. Like the previously-described frame designs, an eccentric bracing system includes beams 24, columns 25, and diagonal bracings 26 and 27. Diagonal bracing 26 is secured within a bay between two beams 24, while one end of diagonal bracing 27 is secured in a vertically adjacent (e.g., next-lower, as shown) bay to a beam 24, with the other end of diagonal bracing 27 being secured to a column 25. Additionally, an end plate 28 is secured to an end of each beam 24. The end plate 28 has holes formed therethrough to facilitate securing the beam 24 to which it is secured to a column 25. Gusset plates 29, which include holes therethrough to facilitate the securing of corresponding ends of a diagonal bracing 26 thereto, are secured to opposed surfaces of the beams 24 that form the top and bottom of a bay within which the diagonal bracing 26 is located. Another gusset plate 31 is positioned at the junction between a column 25 and a base plate 30 that has been secured to the bottom, or base, of the column 25. The gusset plate 31 includes holes to facilitate securing of a lower end of a diagonal bracing 27 thereto, the opposite, upper end of the diagonal bracing 27 being secured to a beam 24 by way of a gusset plate 29 protruding from the bottom of the beam 24.

It can be seen in FIG. 6 that the centerline of diagonal bracing 26 and the centerline of beam 24 meet at point "k", whereas the centerline of column 25 and the centerline of beam 24 meet at point "h". Thus there is an eccentricity of 'e1' (i.e., the distance h–k).

Eccentric bracing systems are not as stiff as concentric bracing systems. Under severe seismic load, a hinge in the beam is formed at point "k", leading to dissipation of considerable energy. However, due to severe plastic hinge deformation of the beam link at point "k", frames which employ eccentric bracing systems suffer from considerable drift, even under loads applied thereto by moderate earthquakes. Moreover, repairing the shock-absorbing capabilities of eccentric bracing systems is very expensive.

According to a report published in 1988, Nippon Steel Company, has developed a so-called "unbonded brace" for use as a diagonal bracing in earthquake-resistant building frames. FIGS. 9*a*–9*f* depict an example of such an unbonded brace 48, while FIGS. 10*a*–10*c* show use of that unbonded brace 48 in a building frame.

As shown in FIGS. 9*a*–9*f*, unbonded brace 48 includes a yielding core 41, a flexible coating of "unbending material" 42 that surrounds the yielding core 41, grout 44 surrounding the yielding core 41 and the unbonding material 42, and a hollow steel sleeve 43 which contains the grout 44, the unbonding material 42, and a substantial portion of the length of the yielding core 41. The core 41, which is depicted, without limitation, as having a rectangular cross-section, includes coupling ends 45, or "plus sections," that are provided with holes to facilitate securing of the coupling ends 45 and, thus, of the yielding core 41 of the unbonded brace 48 to corresponding gusset plates that have been secured to a frame of a building.

A hollow pocket S having a length L1 remains at both ends of the grout 44 so that the coupling ends 45 of the yielding core 41 will not collide with and, thus, impact the grout 44 as the yielding core 41 is compressed. Each pocket S is filled with flexible polystyrene 46.

The unbending material 42, which has a length L2 along a central section of the yielding core 41 ensures that the grout 44 does not bind to the yielding core 41 and that an axial load on the yielding core 41 is not transferred to the grout 44 or to the sleeve 43. Thus, the axial load is resisted only by the yielding core 41.

The grout 44 and the sleeve 43, by the virtue of their flexural stiffness, prevent lateral buckling of the yielding core 41.

As shown in FIG. 10*a*, the unbonded brace 48 has been used as a diagonal bracing in earthquake-resistant building frames to control lateral drift thereof and also to absorb energy which is transferred to such frames. A building frame fitted with this unbonded brace 48 also includes columns 46 and beams 47. The unbonded brace is secured to the frame, proximate to junctions between the columns 46 and beams 47, by way of gusset plates 49 that have been secured to a column 46 and a beam 47 at a junction thereof.

FIG. 10*b* shows the earthquake-induced lateral loads F1, F2, and F3, which act in the directions of the illustrated arrows. Under this loading, the unbending brace 48 will be in tension. The yielding core 41 of the unbonded brace 48 will resist this tension and has the capacity to absorb energy when subjected to a tensile force beyond the yield strength thereof. Thus, substantial energy will be absorbed during severe earthquakes. The lateral drift is also controlled.

FIG. 10*c* shows the reversed earthquake-induced lateral loads F1, F2, and F3 acting in the directions of the corresponding depicted arrows. Under this loading, the unbonded brace 48 is in compression. Then the yielding core 41 of the unbonded brace 48 will start to buckle, but the grout 44 and the sleeve 43 will prevent the yielding core 41 from buckling. The yielding core 41 can absorb significant energy, even under compressive force, when loaded beyond its yield strength during a severe earthquake.

One of the drawbacks of the Nippon Steel Company unbending brace 48 is the potential for damage to and/or degradation of the unbonding material 42 over the course of time or following tension and/or compression of the yielding core 41 of such an unbending brace 48. If the unbonding material 42 degrades or becomes damaged, friction will develop between the yielding core 41 and the grout 44. As a consequence, axial loading of the yielding core 41 will be undesirably transferred to the grout 44 and the sleeve 43.

Moreover, the flexible polystyrene 46 used in such unbending braces 48 is not fully fire resistant. Nor, as shown in FIG. 11*a*, can the flexible polystyrene 46 be relied upon to provide sufficient lateral support to the thin yielding core 41. While unbending brace 48 works well provided the axial force acting on the yielding core 41 is concentric, i.e., center lines through the unbonding brace 48, the beam 47, and the column 46 intersect at a single point. If there is an eccentricity "e2" due to fabrication deviations, then the yielding core 41 will no longer be carrying purely axial load, but will be subjected to a bending moment Ml equal to the axial force F3 multiplied by the eccentricity "e2". Consequently, the yielding core 41 may bend in the gap L1, as shown in FIG. 11*b*. This bending of the yielding core 41 will cause premature failure of the unbending brace 48. Furthermore, the unbending brace 48 is rigidly connected to the building frame with several bolts instead of a single pin joint. This type of multiple bolted connection causes secondary moments on the yielding core 41. This secondary moment M also causes the core to bend, as shown in FIG. 11*b*. Also the grout 44 will be generally of considerable self weight and due to lateral acceleration of the building during a severe earthquake, this self weight of grout itself generates lateral forces and bending moments on the thin yielding core 41. Furthermore, during a severe earthquake, the cladding materials like bricks, tiles etc., may loosen first and fall on the bracing member. This falling debris may also result in bending of the yielding core 41 within the gap L1.

Another drawback of the Nippon Steel Company unbonded brace 48 is that if it is to be long for use in a large structure, then the axial deformation of the yielding core 41 will also be very large. Hence, the gap L1 (FIG. 9*a*) will also have to be large. Here again, as the brace tends to be very heavy due to the weight of the grout therein, problems may occur due to local buckling of the yielding core 41 in the gap L1.

In the United States, The American Institute of Steel Construction (AISC) has published specifications for the design of steel structures. Their specifications are widely followed by design engineers. A committee of AISC has prepared a draft specification for buckling restrained braces which is likely to be incorporated, as an appendix, into the AISC Code of Practice. The draft specification specially mentions that the bracing member should be capable of resisting any bending moment and lateral forces caused are eccentricity of connections and other factors.

The unbonded bracing system of Nippon Steel Company uses the basic principles that have been disclosed in Indian Patent No. 155036, for which an application was filed on Apr. 30, 1981 (hereinafter "the Indian Patent"), and in U.S. Pat. No. 5,175,972, issued Jan. 5, 1993 (hereinafter "the '972 patent"). Each of these systems includes a yielding core and a sleeve to restrain the yielding core from buckling.

The column of the Indian Patent is depicted in FIGS. 7*a* and 7*b* and includes a tubular sleeve 32 having a circular cross-section and a core rod 33 housed inside the sleeve 32. A gap of predetermined distance separates the core rod 33 from the sleeve 32. The Indian Patent also discloses that "[t]he sleeve can be isolated from the core by providing rubber washers with the result that performance is better under vibratory conditions." A first end of the core rod 33 extends a predetermined distance beyond the corresponding first end of the sleeve 32. In addition, the column of the Indian Patent is described as including a base plate 34 secured to the second end of the sleeve 32.

In addition, FIG. 7*a* depicts the application of an axial load W to the core rod 33. The column shown in FIG. 7*a* supports the axial load W in the following manner: The load W is resisted only by the core rod 33, not by the sleeve 32. Without the presence of sleeve 32 surrounding the core rod 33, the load W that has been applied to the core rod 33 will cause the core rod 33 to buckle. However, since the sleeve 32 surrounds much of the core rod 33, the core rod 33 will come in to contact with the inside surface of the sleeve 32 which, by virtue of its flexural stiffness, will prevent any further lateral buckling of the core rod 33. Thus, the core rod 33 alone supports the entire load and the sleeve 32 acts merely as a buckling restraining member. Accordingly, with this arrangement, it is possible to load the core rod 33 beyond its yield strength and to cause it to absorb energy by providing a surrounding sleeve 32 with suitable flexural stiffness.

FIGS. 8*a* and 8*b* depict the scaffolding prop that is described in the '972 patent. That scaffolding prop includes a plurality of core rods 35, 36 that have been placed, end-to-end, inside a hollow sleeve 37, with a small, predetermined annular gap therebetween. One long core rod can be used in place of the plurality of core rods 35, 36.

The uppermost core rod 36, which protrudes beyond the sleeve 37, has threads 38 at an upper end thereof to facilitate securing thereof to a socket 38 that is associated with a roof slab 40 of a building that is supported by the scaffolding prop. The socket 38 does not contact the edge of the sleeve 37. A base plate 39 is rigidly secured to a bottom end, or base, of the sleeve 37. The bottom-most core rod 35 rests freely on the base plate 39.

The scaffolding prop of FIG. 8*a* supports the load of the roof slab in the following manner: the weight of the roof slab 40 is transferred to the ground, sequentially, through the socket 38, the core rods 36, 35, and the base plate 39. Without the sleeve 37, the core rods 35, 36, would buckle when subjected to a compressive load due to the weight of the roof slab 40. The sleeve 37, however, prevents such buckling. In particular, when a compressive load is applied to the core rods, 35, 36, the sides thereof will contact the inside surface of the sleeve 37 and the sleeve 37, by the virtue of its flexural stiffness, will prevent the further lateral buckling of the core rods 35, 36. Thus, the core rods 35, 36 will absorb the majority of the load placed thereon. The sleeve 37 acts primarily as a buckling restraining member. Thus, it is possible, by giving suitable flexural stiffness to sleeve 37, to load the core rods 35, 36 beyond their collective yield strength, allowing them to absorb shock energy.

During earthquakes in Kobe, Japan, San Francisco, Calif., and Turkey, many buildings were totally destroyed, even though many of them had been designed with frames that incorporated the foregoing systems.

There is, therefore, an urgent need to develop a safer, more effective bracing system.

SUMMARY OF THE INVENTION

The present invention includes buckling restrained braces and systems in which such braces are used. The buckling restrained braces of the present invention may be used in seismic retrofits to increase the safety of existing buildings, particularly, the earthquake-prone areas thereof, which may or may not have been damaged by earthquakes. The buckling restrained braces are also useful in new building construction.

A buckling restrained brace, or "sleeved bracing member," that incorporates teachings of the present invention includes an elongate yielding core which is disposed within an elongate outer sleeve. The yielding core may be surrounded by a buckling-constraining material, such as grout (e.g., concrete), also contained within the outer sleeve. An air gap separates at least one surface of the yielding core from the adjacent outer sleeve, buckling-constraining material, or a liner along an inner surface of the buckling-constraining material.

The yielding core of the buckling restrained brace is configured to absorb both compressive and tensile loads, with the outer sleeve, buckling-constraining material, or both preventing buckling of the yielding core as a compressive load is applied thereto.

In use, the buckling restrained brace absorbs much of the potentially damaging loads that are applied to a structural steel frame during earthquakes, high winds, and other loading conditions.

Other features and advantages of the present invention will become apparent to those of ordinary skill in the art through consideration of the ensuing description, the accompanying drawings, and the appended claims.

BRIEF DESCRIPTION OF THE DRAWINGS

In the drawings, which depict prior art structures, as well various aspects of exemplary embodiments of the present invention.

Figure 1A:
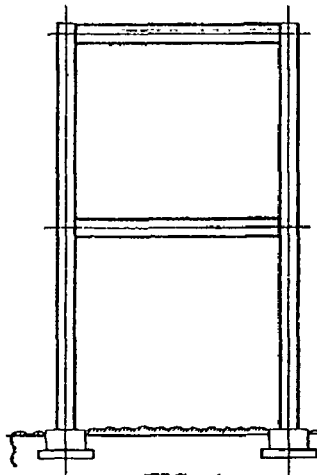
FIGS. 1*a*–1*i* schematically depict various types of forces or loads that are applied to a structural steel frame during an earthquake or other seismic activity.
Figure 1B:
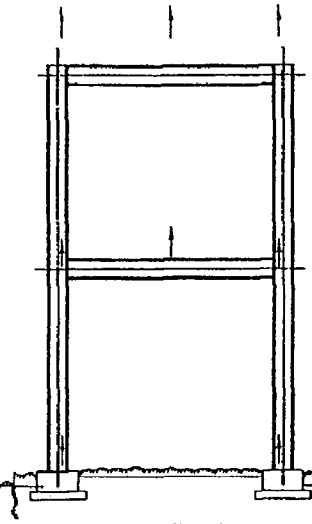
Figure 1C:
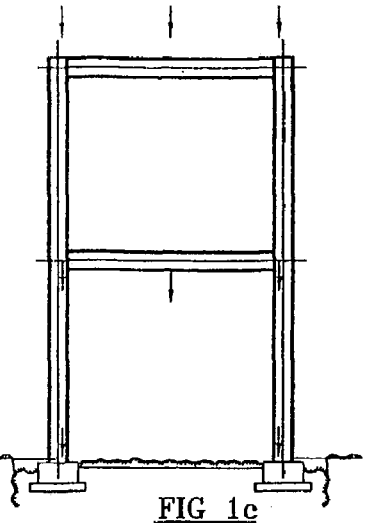
Figure 1D:
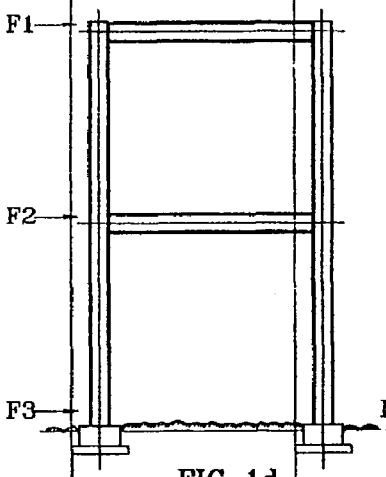
Figure 1F:
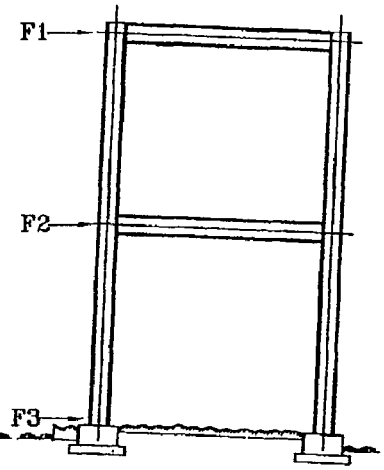
Figure 1G:
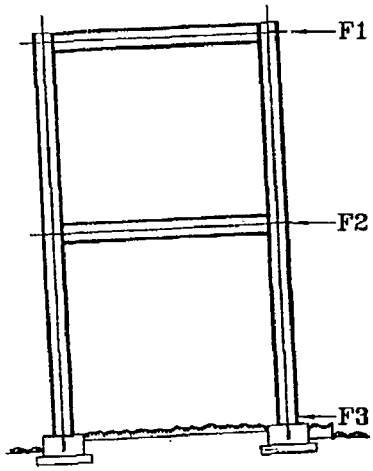
Figure 1E:
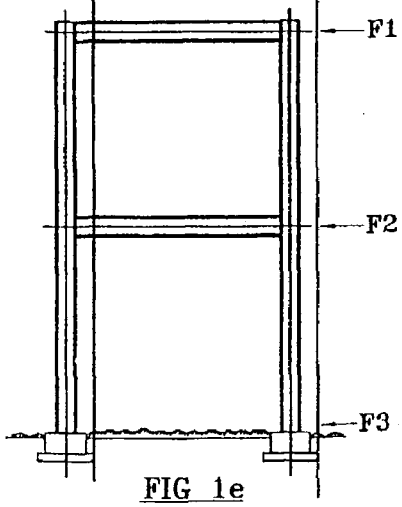
Figure 1H:
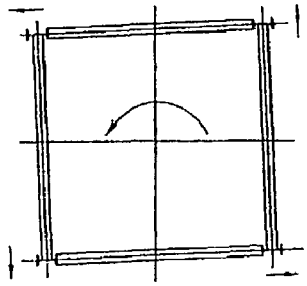
Figure 1I:
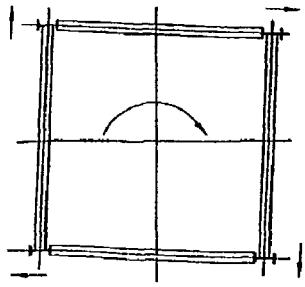
Figure 2A:
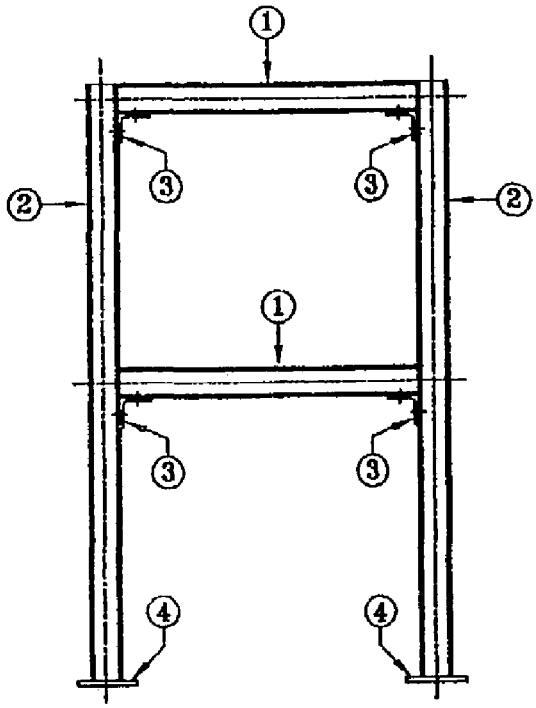
FIG. 2*a* schematically depicts a conventional structural steel frame.
Figure 2B:
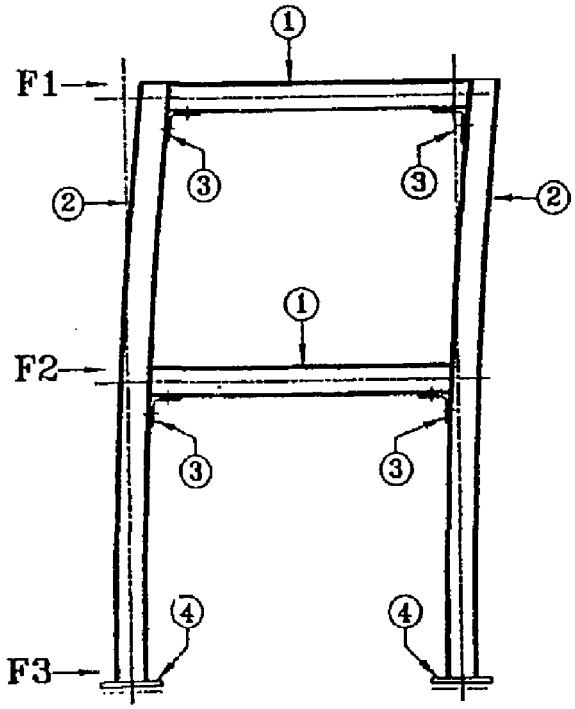
FIG. 2*b* shows lateral sway of the structural steel frame of FIG. 2*a* as seismically-induced loads are applied thereto.
Figure 3A:
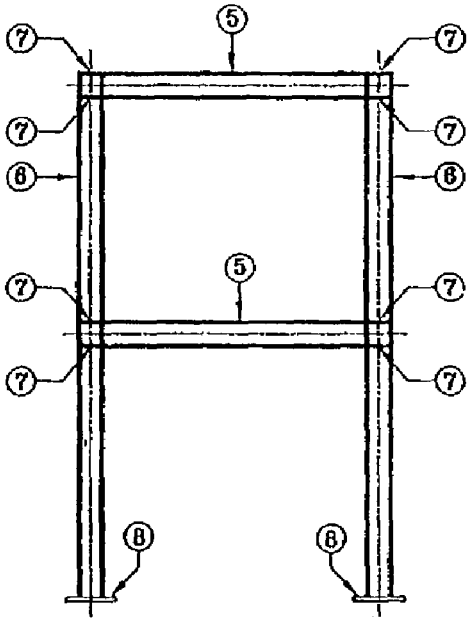
FIGS. 3*a*–3*c* schematically depict a stiffened structural steel frame.
Figure 3D:
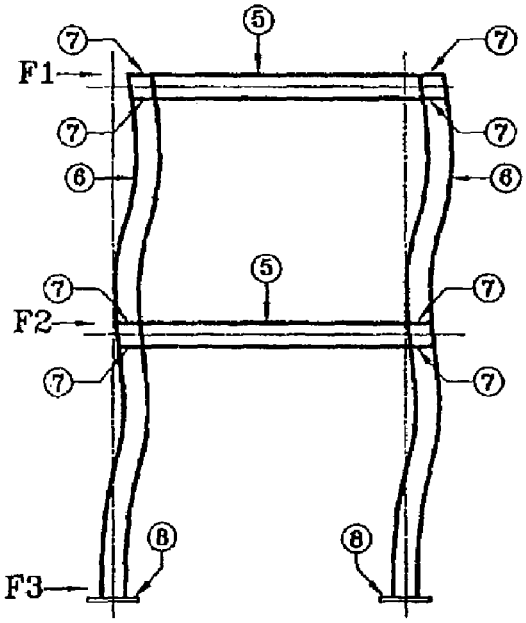
Figure 3B:
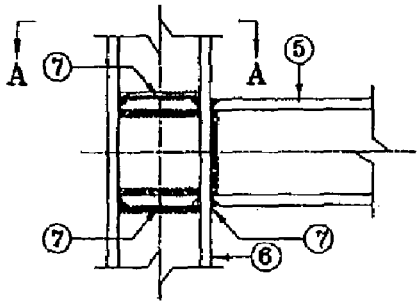
Figure 3C:
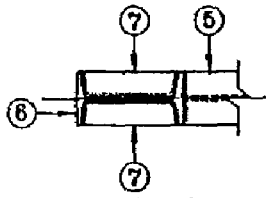
Figure 4A:
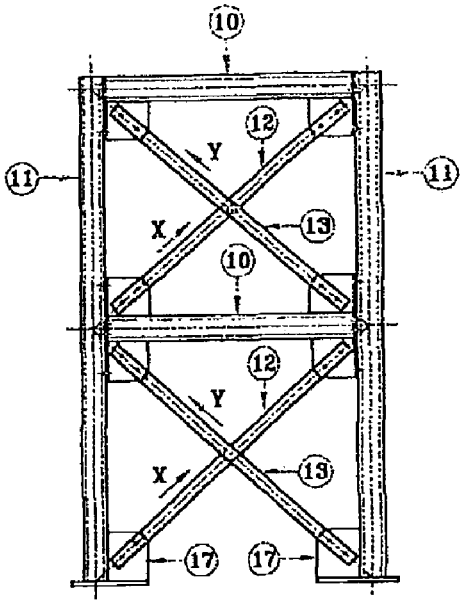
Figure 4C:
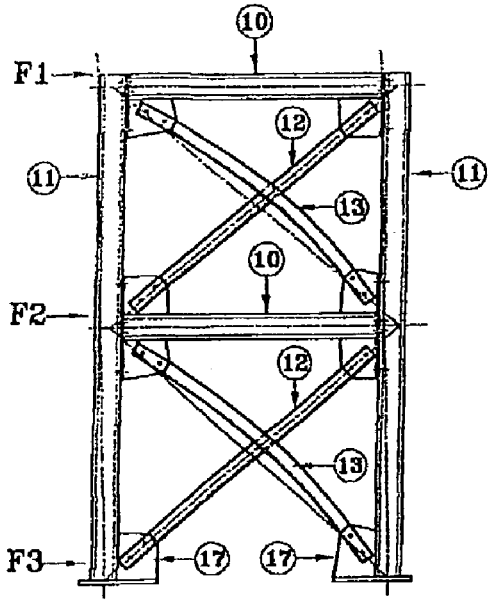
Figure 4B:
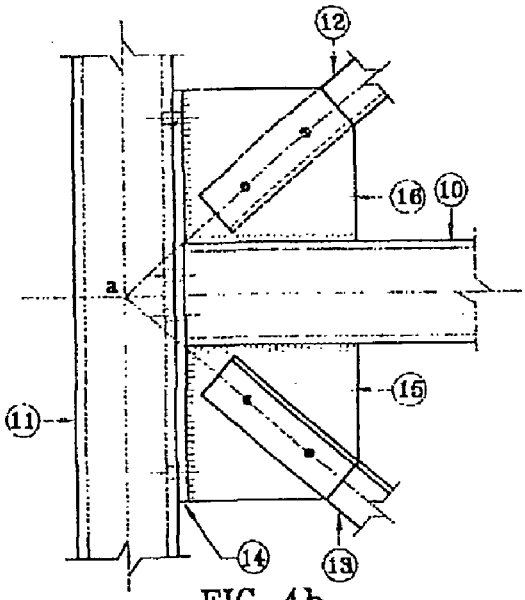
Figure 4D:
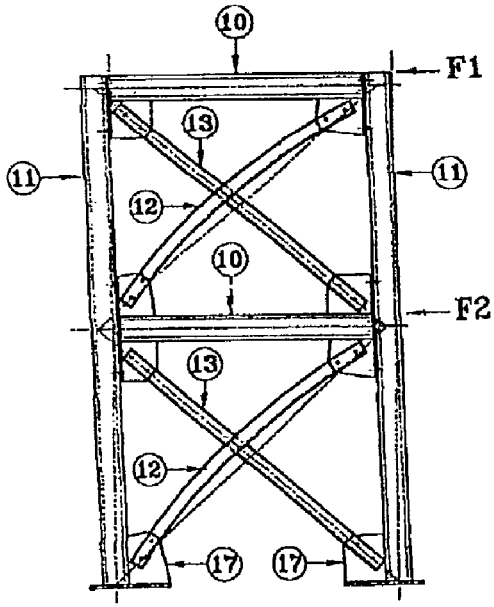
Figure 5A:
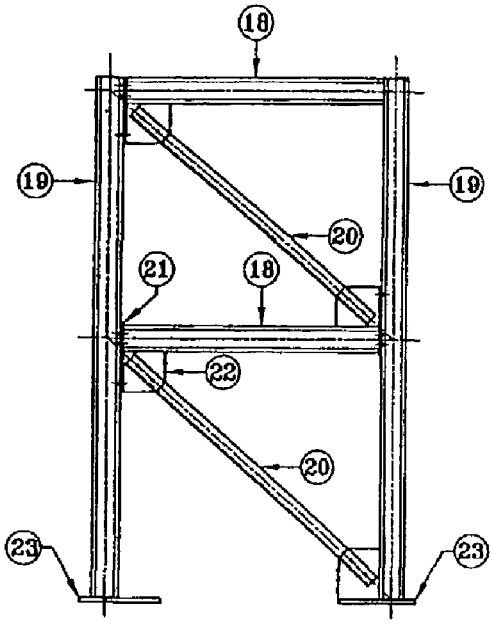
Figure 5C:
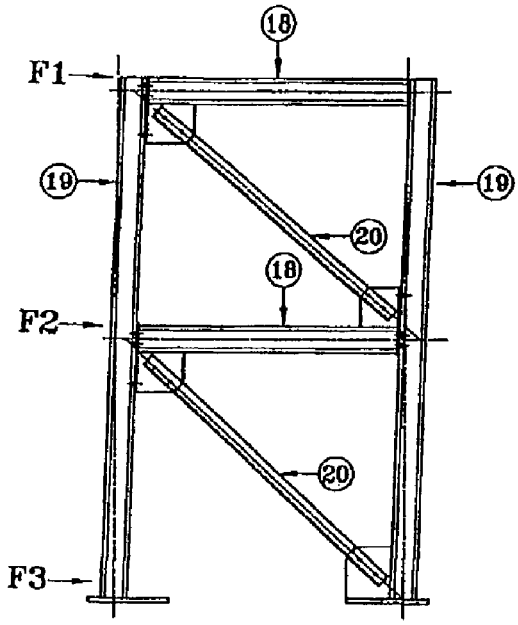
Figure 5B:
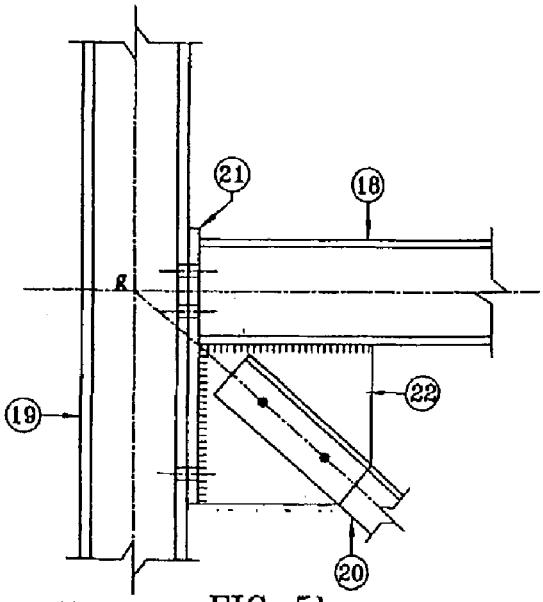
Figure 5D:
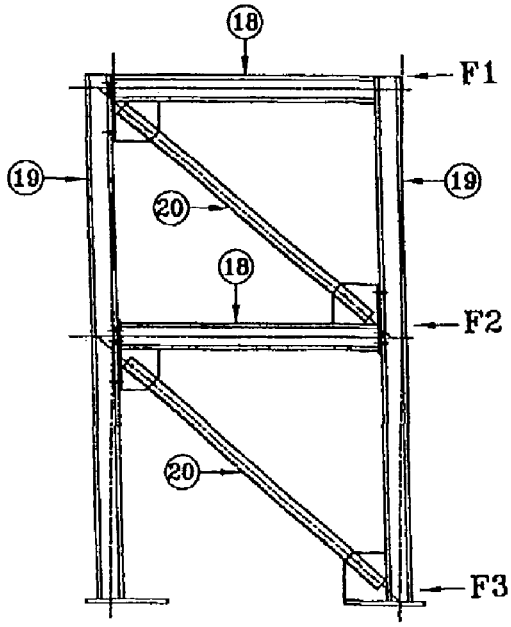
Figure 6:
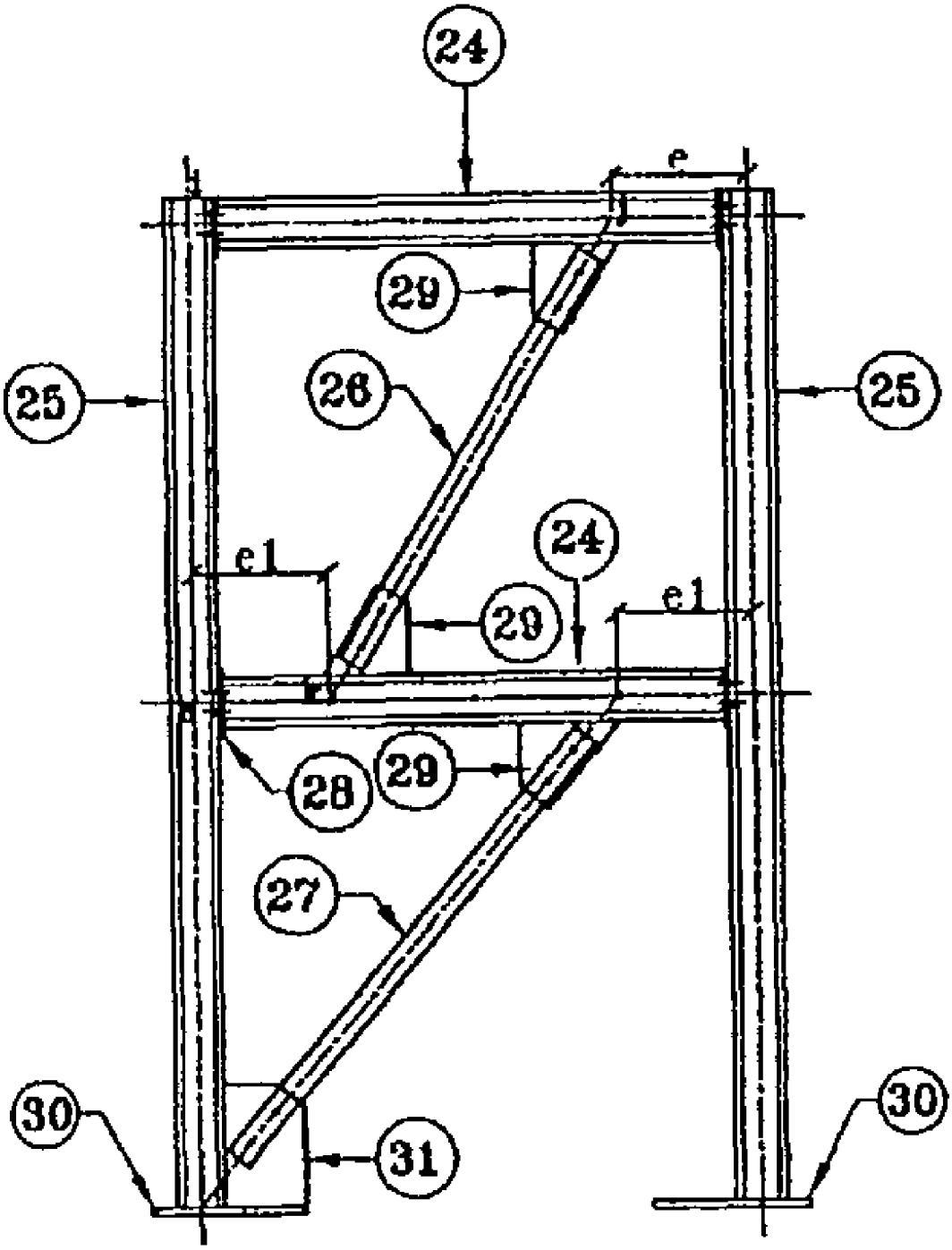
Figure 7A:
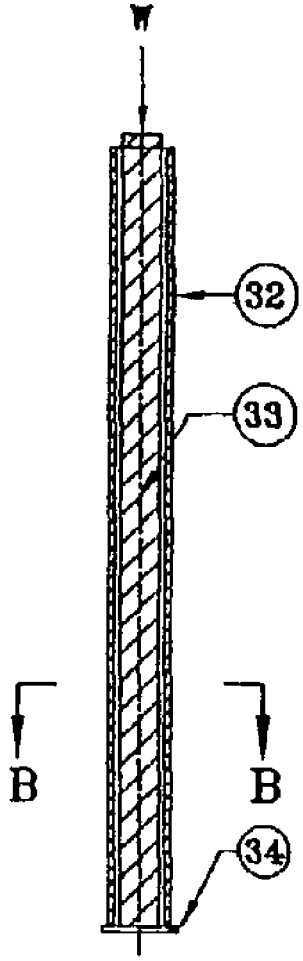
Figure 7B:
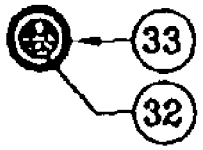
Figure 8A:
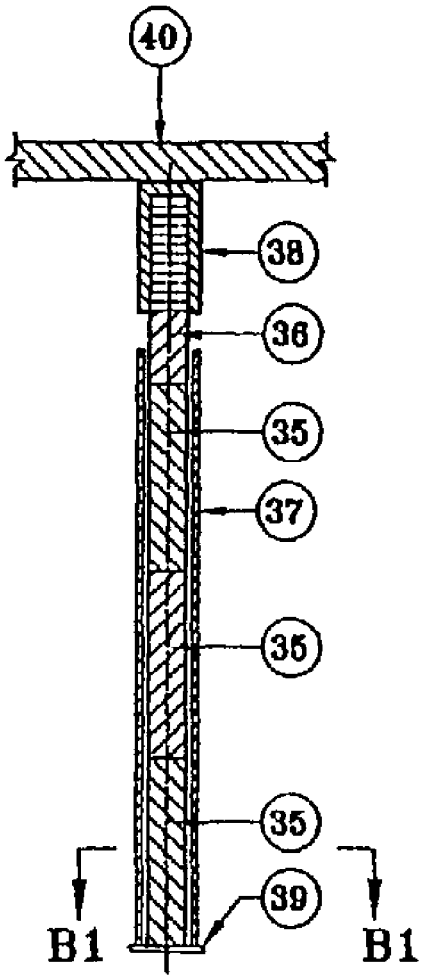
Figure 8B:
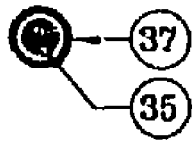
Figure 9B:
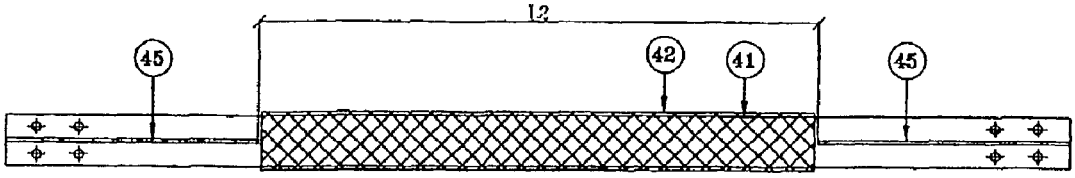
Figure 9A:
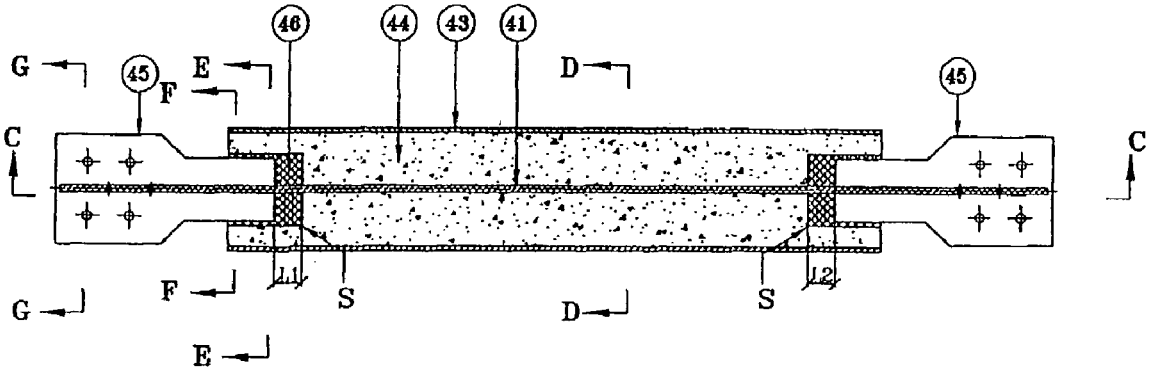
Figure 9C:
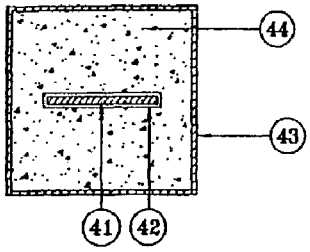
Figure 9D:
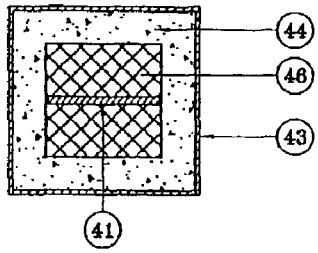
Figure 9E:
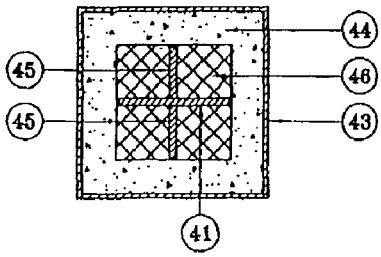
Figure 9F:
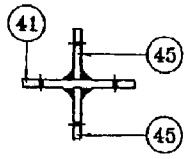
Figures 10A, 10B, 10C:
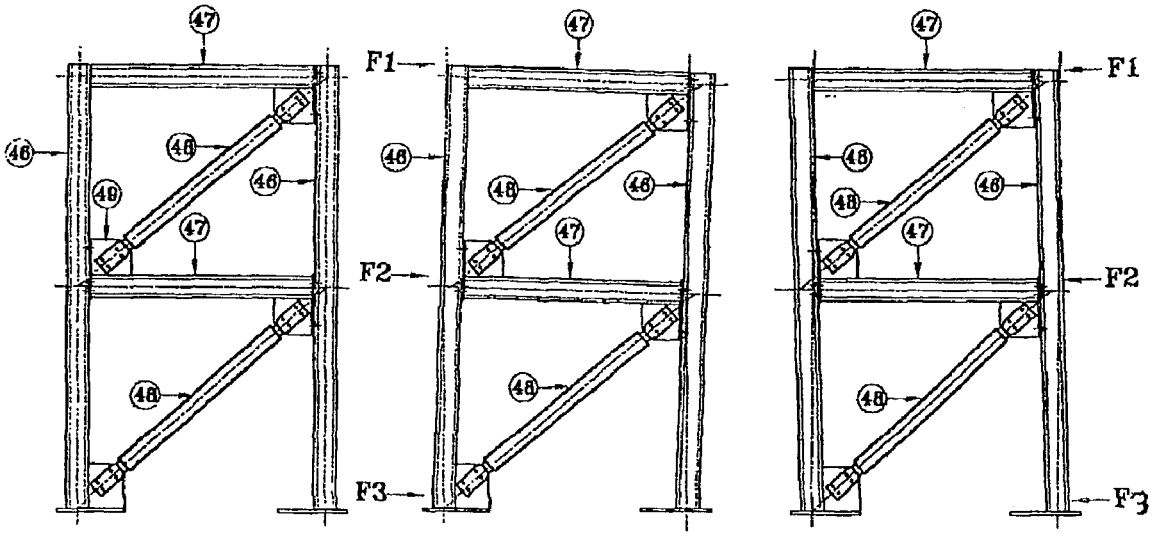
Figure 11A:
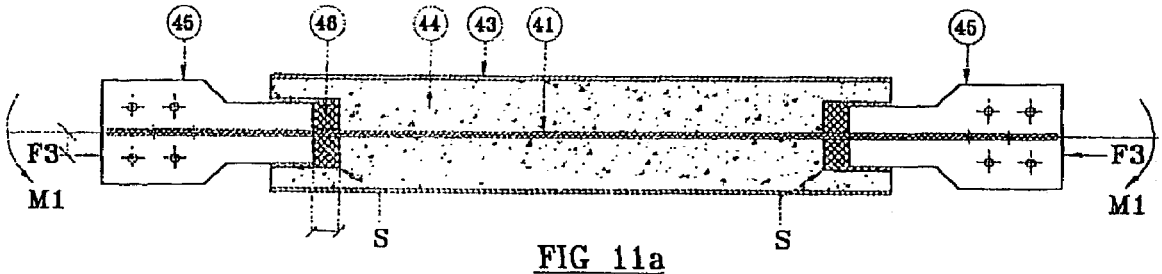
Figure 11B:
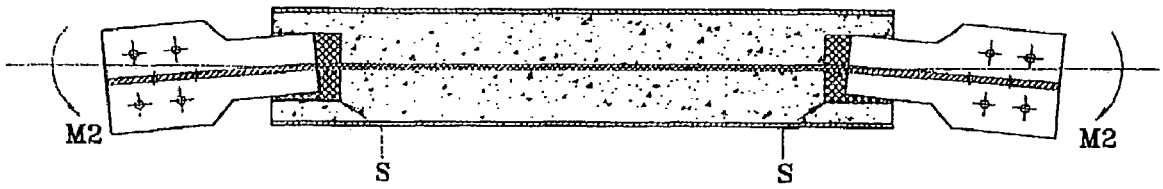
Figure 12A:
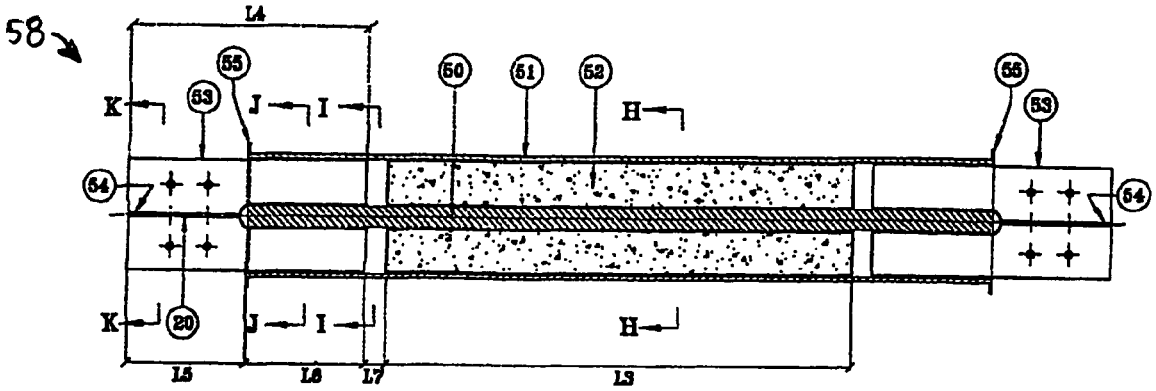
Figure 12B:
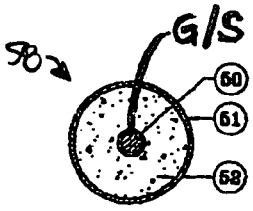
Figure 12C:
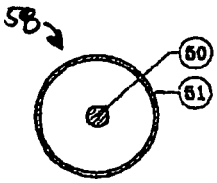

FIG; 3*d* shows the deflected shape of the structural steel frame of FIGS. 3*a*–3*c* as seismic loads are applied thereto;

FIGS. 4*a* and 4*b* schematically depict a structural steel frame with tension-only braces positioned in an "X" configuration of various bays thereof;

FIGS. 4*c* and 4*d* show bowing of the braces of FIGS. 4*a* and 4*b* as compressive loads are applied thereto;

FIGS. 5*a* and 5*b* schematically depict a structural steel frame with braces that are configured to receive both compressive and tensile loads;

FIGS. 5*c* and 5*d* illustrate the structural steel frame of FIGS. 5*a* and 5*b* as seismically-induced loads are applied thereto;

FIG. 6 schematically depicts a structural steel frame that includes eccentrically arranged braces;

FIGS. 7*a* and 7*b* schematically depict a prior art column with an outer sleeve and an inner yielding core;

FIGS. 8*a* and 8*b* schematically depict a scaffold support that includes an outer sleeve with a yielding core that includes a plurality of members that are positioned in an end-to-end relationship;

FIGS. 9*a*–9*f* are various views of a prior art buckling restrained brace which includes an outer sleeve, an elongate yielding core within the outer sleeve, a grout material within the outer sleeve and surrounding the yielding core, and an unbonding material separating the grout material from the yielding core;

FIGS. 10*a*–10*c* show a structural steel frame that includes the braces of FIGS. 9*a*–9*f* and the application of seismically-induced loads thereto;

FIGS. 11*a* and 11*b* illustrate potential damage to the yielding core of the brace shown in FIGS. 9*a*–9*f* as lateral and secondary loads are applied thereto;

FIG. 12*a* is an axial cross-sectional representation of an exemplary embodiment of buckling restrained brace according to the present invention;

FIGS. 12*b*–12*e* are cross sections that are respectively taken along lines H—H, I—I, J—J, and K—K of FIG. 12*a;*

Figure 12D:
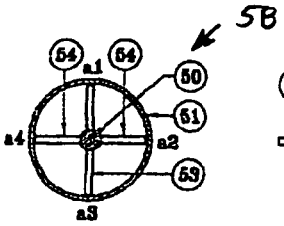
Figure 12E:
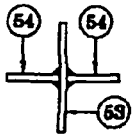
Figure 12F:
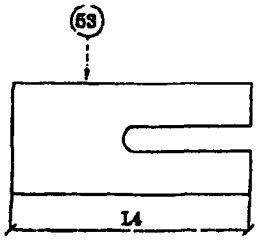
Figure 12G:
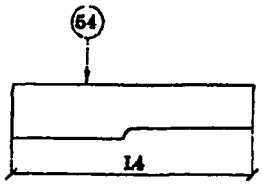

FIGS. 12*f* and 12*g* are plan view of gussets of the buckling restrained brace of FIG. 12*a;*

Figures 13A, 13B, 13C:
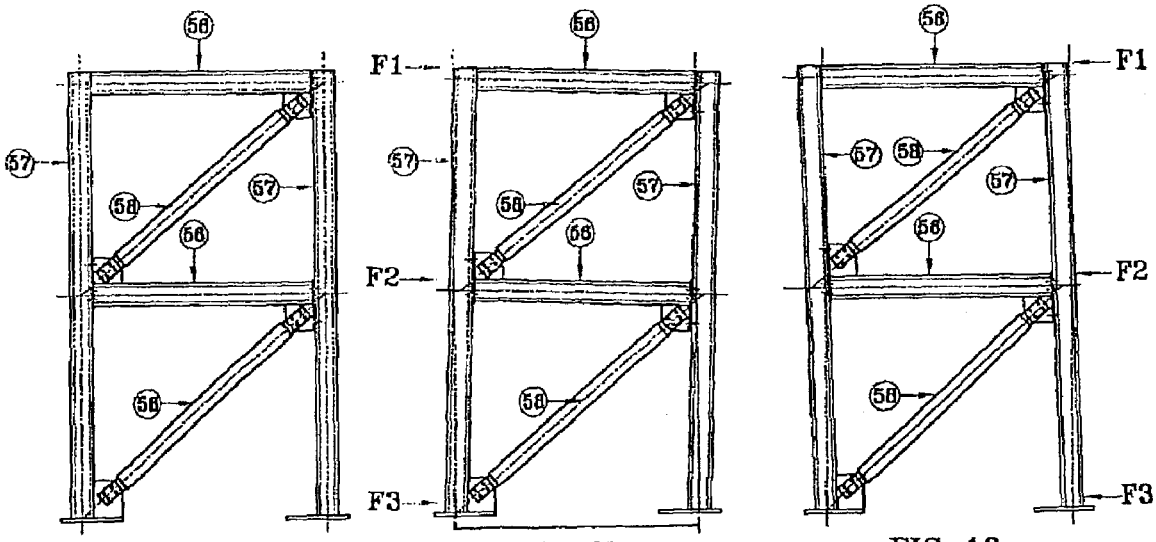
Figure 14B:
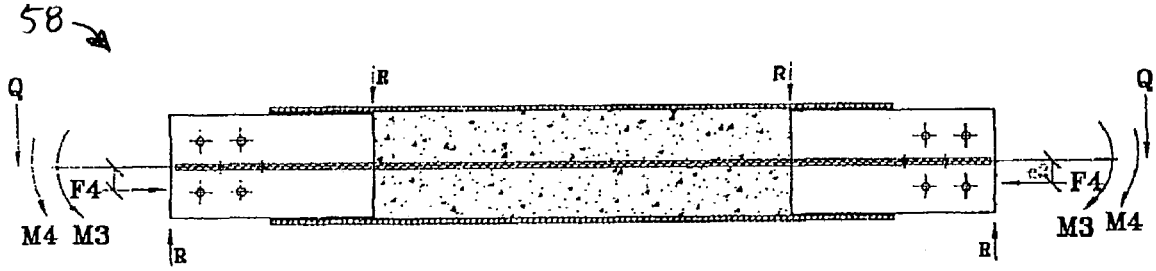
Figure 14A:
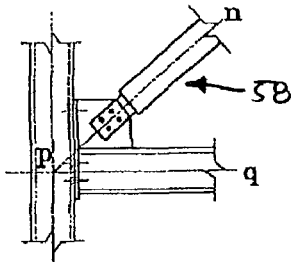

FIGS. 13*a*–13*c* show a structural steel frame that includes buckling restrained braces according to the present invention, as well as the application of seismically-induced loads to the structural steel frame;

FIG. 14*a* is an axial cross section that depicts lateral and secondary loads that may be applied to the buckling restrained brace of FIG. 12*a;*

Figure 15A:
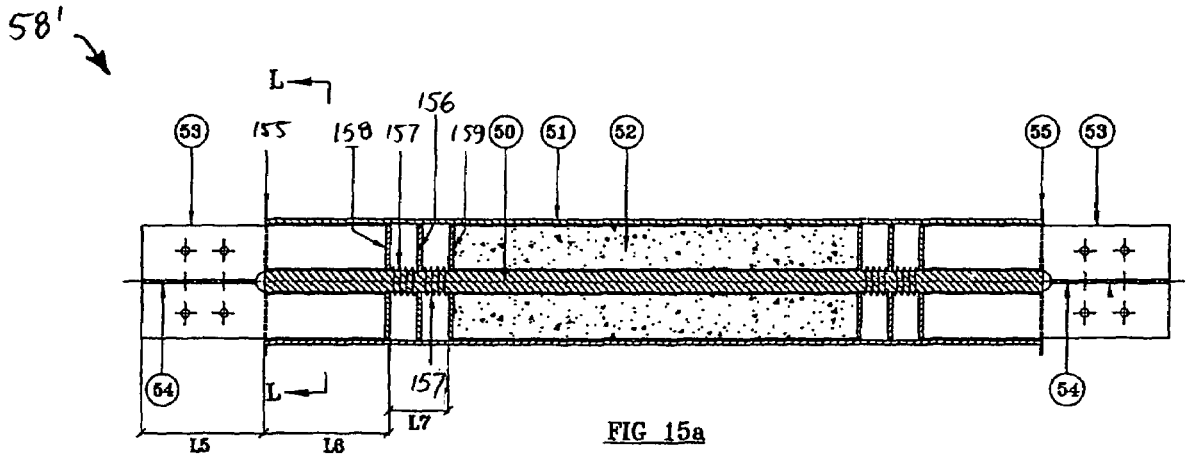
Figure 15B:
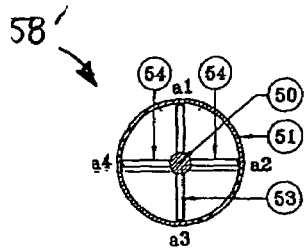
Figure 16A:
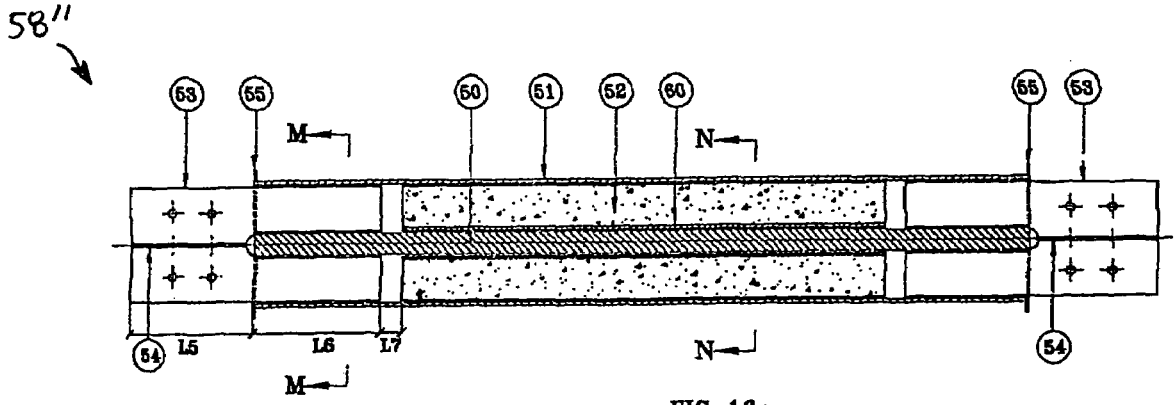
Figure 16C:
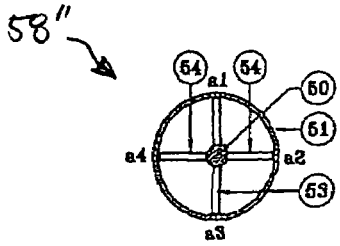
Figure 16B:
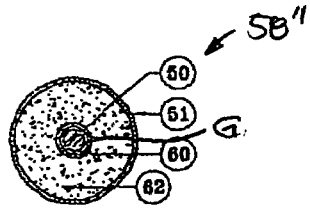
Figure 17A:
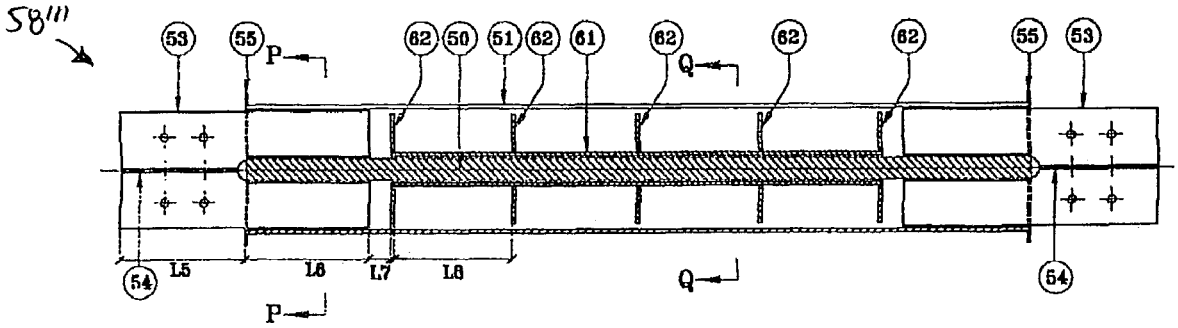
Figure 17C:
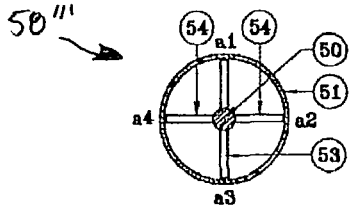
Figure 17B:
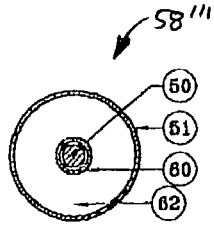

FIG. 14*b* schematically depicts connection of the buckling restrained brace of FIG. 14*a* to a structural steel frame;

FIGS. 15*a* and 15*b* are representations of yet another embodiment of buckling restrained brace of the present invention, which includes sliding washers surrounding portions of the yielding core thereof so as to radially support the same;

FIGS. 16*a*–16*c* show an example of a buckling restrained brace that includes an inner sleeve, or liner, that concentrically surrounds the yielding core thereof and which is spaced apart from the yielding core;

FIGS. 17*a*–17*c* illustrate an example of a buckling restrained brace that includes a buckling constraining member comprising an inner sleeve and plate washers in place of grout.

DETAILED DESCRIPTION

With reference to FIGS. 12*a*–12*g*, an exemplary embodiment of buckling restrained brace 58 according to the present invention is depicted. Buckling restrained brace 58 includes an elongate core rod 50, or "yielding core," an elongate hollow sleeve 51 within which the core rod 50 is concentrically disposed, and a buckling constraining element, in this case a grout material 52, that fills a portion, shown as radial distance L3, of an annular gap between the core rod 50 and sleeve 51. An air gap remains between at least one surface of the core rod 50 and the grout material 52. The core rod 50 may be loosely disposed within and surrounded by the grout material 52.

In the depicted example, the core rod 50 has a solid round cross section, which may better resist buckling thereof than would a core rod 50 of rectangular cross section. Alternatively, the core rod 50 may have a cross-sectional shape, taken transverse to the length thereof, which is rectangular, square, or any other shape. Further, rather than be solid, the core rod 50 may be hollow or comprise a box section.

The core rod 50 has a cross-sectional area that, as known in the art, permits it to enter a plastic state (i.e., a state in which the core rod is stressed beyond its yield strength) when tension and compression loads of a "normal" earthquake, as defined by relevant code, are applied thereto. As the core rod 50 enters a plastic state, it will absorb substantial amounts of energy. Additionally, the design of the core rod 50 may comply with the applicable safety requirements. Further, the core rod 50 may be designed in such a way to impart an unsupported portion of the length thereof (i.e., that located within a gap L7 near the ends of the sleeve 51) with sufficient strength to withstand lateral loads. For example, the core rod 50 may be formed from a material which has a yield strength of about 15,000 psi to about 70,000 psi.

The core rod 50 may be formed from a metal (e.g., steel) or any other matrix materials with suitable properties (e.g., plasticity, strength, etc.), such as a graphite composite. Examples of metals from which the core rod 50 may be formed include, without limitation, mild steels, high-strength steels, and the like.

The sleeve 51 is a hollow member which is shown as having a circular cross section, taken transverse to the length thereof. Alternatively, the sleeve 51 may have another rounded cross section (e.g., oval, ellipsoid, etc.), a rectangular (including square) cross section, or any other suitable cross-sectional shape.

The sectional dimensions of the sleeve 51 are configured to have elastic limits that comply with the necessary factor of safety, as stipulated in the relevant code, when subjected to loading from severe earthquakes. The sleeve 51 may also be configured to have sufficient flexural stiffness to prevent the core rod 50 from buckling, even during severe earthquakes, as well as to withstand the lateral forces and bending moments that are transferred to the sleeve 51 due to deviations, or eccentricities, that occur during steel fabrication processes or from erection of the frame. The sleeve 51 may also be designed such that the "Euler Buckling Load" thereof is not less than the maximum force in the core rod 50 multiplied by the required safety factor. By way of example only, the sleeve 51 may have a yield strength of about 25,000 psi to about 100,000 psi.

While designing the sleeve 51, the effect of friction between the core rod 50 and the grout material 52 may also be considered. The effects of such friction may be reduced by covering or coating the sleeve with an anti-friction coating.

The sleeve 51 may be fabricated from a metal (e.g., steel) or any other suitable material (e.g., a graphite composite material). Examples of metals from which the sleeve 51 may be formed include mild steels, high-strength steels, and the like.

Optionally, a stiffening flange 55 may be secured (e.g., by welding) to the end of the sleeve 51.

The grout material 52 which is used in the buckling restrained brace 58 should have enough compressive strength to resist damage thereto (e.g., denting or other conformational changes) as the core rod 50 becomes plastic. The grout material 52 may comprise a suitable concrete, a cement mortar, or a solidifying liquid grout. It is currently preferred that the grout material 52 have a compressive strength of about 1,000 psf or greater, although use of grout materials or other fillers with lower compressive strengths are also within the scope of the present invention. In addition, it is currently preferred that the grout material 52 be substantially homogenous and substantially free of defects (e.g., cracks, honeycomb, etc.).

The air gap G is depicted as a very small annular gap between the core rod 50 and the grout material 52. Such an air gap G prevents the core rod 50 from transferring (compressive) loads that are placed axially thereon to the grout material 52. By way of example only, the air gap G may measure from about 5 mils to about 100 mils.

Additionally, to facilitate securing of the ends of the buckling restrained brace 58 to a steel structural frame, the ends of the core rod 50 may comprise coupling elements, such as the depicted gussets 53. Alternatively, gussets 53 may be secured to the ends of the core rod 50. As shown in FIG. 12*f*, each gusset 53 has a predetermined length L4 and includes a slot formed partially therethrough. The slot of the gusset 53 receives an end of the core rod 50 and the core rod 50 and the gusset 53 are secured to one another, as known in the art (e.g., by welding). Also, the gusset 53 may include holes to facilitate securing thereof and, thus, of the buckling restrained brace 58 to the beams and columns of a steel frame of a building or other structure.

FIG. 12*g* shows another gusset 54, which is configured to be secured to gusset 53. in particular, two gussets 54 are secured (e.g., by welding) to opposite sides of gusset 53 along length L5 and to opposite sides of the core rod 50 over length L6 and are oriented substantially perpendicular to gusset 53 so as to provide a cruciform, or "plus," section, as shown in FIGS. 12*d* and 12*e*. Like gussets 53, gussets 54 may include holes that facilitate securing thereof and, thus, of the buckling restrained brace 58 to the beams and/or columns of a steel frame.

The widths of the gussets 53 and 54 are configured to facilitate sliding thereof inside the sleeve 51. In addition, a gap L7 of predetermined length is located between and end of the grout material 52 and an adjacent end of the gussets 53, 54 to facilitate movement of the gusset plates 53, 54, along edges a1, b1, c1, and d1, into and out of the sleeve 51 during and following the application of a compression load to the core rod 50. Thus, the length of the gap L7 is sufficient to facilitate shortening of the core rod 50 when a compressive load is applied thereto.

It should be noted that when the compressive force acts, not only does the plus section formed by gussets 53, 54 undergo a shortening in length, it also bulges laterally due to the "Poisson" effect. It is essential as per this invention that the plus section formed by the core rod 50 and the gussets 53, 54 slides freely inside the sleeve along edges a1, a2, a3 & a4 (FIG. 12*c*) even after lateral bulging. The gap between the plus section and the sleeve 51 should be just enough to meet this requirement and not more. A larger gap would make the plus section behave differently as will be explained in further chapters.

The opposite ends of the gussets 53, 54 protrude beyond the sleeve 51 by a predetermined length L5 to facilitate securing of the gussets 53, 54 and, thus, of the buckling restrained brace 58 to a steel frame.

Such a buckling restrained brace 58 may be manufactured by cutting a core rod 50 and hollow sleeve 51 that have been fabricated with desired dimensions to desired lengths. Gap-producing spacers S, such as thin shims, may then be secured (e.g., with clamps) to one or more surfaces of the core rod 50 (e.g., three or four surfaces of a core rod 50 with a rectangular cross section) so as to substantially cover each such surface. The gap-producing spacers S may be at least partially coated with a suitable release agent (e.g., grease, silicone, etc.) to facilitate their subsequent removal from between grout material 52 and the core rod 50. The core rod 50-spacer S assembly is positioned and aligned (e.g., centrally or at any other desired location) within the sleeve 51. One or more caps are then secured within the sleeve 51 and around the core rod 50 so as to provide containment for the subsequently introduced grout material 52. The grout material 52 may then be pumped, vibrated, or poured into the area between the sleeve 51, the spacers and/or core rod 50, and the caps. If the grout material 52 is to be introduced while the buckling restrained brace 58 is horizontally oriented, two caps may be used and pumping or vibration processes may be employed. If the buckling restrained brace 58 is oriented somewhat vertically during introduction of the grout material 52, a single cap may be used (e.g., proximate the bottom end of the sleeve 51) and the grout material 52 may be poured, pumped, or vibrated. The grout material 52 is then permitted to solidify. Once the grout material 52 has sufficiently solidified (e.g., to a compressive strength of about 500 psf or greater), one or more of the spacers S may be removed to form an air gap G between the core rod 50 and the grout material 52. Alternatively, the spacers S may comprise a material which may be removed by dissolving, burning, melting, or evaporating the same. Optionally, two or more superimposed spacers S may be used, with one of the spacers remaining adjacent to the grout material 52 while one or more other spacers S are removed to form the gap G between the core rod 50 and the grout material 52.

FIGS. 15*a* and 15*b* depict another embodiment of buckling restrained brace 58' of the present invention. Buckling restrained brace 58' includes each of the elements of the buckling restrained brace 58 depicted in FIGS. 12*a*–12*g*, as well as a washer 156 that is located within the gap L7, concentrically surrounds the portion of the core rod 50 located therein, and includes an outer periphery which is positioned adjacent to and may abut an inner surface of the sleeve 51. In addition to the washer 156, the buckling restrained brace 58' includes springs 157 abutting each planar surface of the washer 156 and also concentrically surrounding the portion of the core rod 50 located within the gap L7. The opposite ends of the springs 157 abut end plates 158 and 159 which are also located within ends of the gap L7 and through which the core rod 50 extends. One of the end plates 158 is positioned at an inner end of each plus section formed by assembled gussets 53 and 54. The other end plate 159 is positioned adjacent to and end of the grout material 52.

The washer 156 effectively splits the unsupported length of the core rod 50 within the gap L7 in half. As the axial load on the core increases, the length of the gap L7 reduces. If the washer 156 is secured to neither the core rod 50 nor the sleeve 51, it may slide relative thereto. Additionally, if springs 157 on opposite sides of the washer 156 are substantially identically configured, the washer 156 they may exert substantially equal forces on opposite sides thereof, causing the washer 156 to remain substantially at the center of the gap L7 any given length thereof. When the washer 156, springs 157, and end plates 158 and 159 are used, additionally support is provided to the core rod 50, thereby facilitating the use of very thin core rods 50. This is particularly true if very high strength steel were used for the core rod (50).

Optionally, more than one washer 156 and more than one set of springs 157 may be used within each gap L7. For example, two washers 156 and three springs 157 could be used. This configuration allows for larger axial deformation of the core rod 50 than the single-washer 156 configuration and may, therefore, facilitate the absorption of more shock energy than the single-washer 156 configuration. An experimental steel staging supporting a water tank was designed, fabricated and load tested where in the columns were designed like the bracing member of this invention and with two sliding washers plates and three spring washers.

Turning now to FIGS. 16*a*–16*c*, an embodiment of buckling restrained brace 58" is shown that includes each of the same elements as buckling restrained braces 58 and 58', as well as a thin metallic or non-metallic inner sleeve 60 which is provided concertrically around at least a portion of the length of the core rod 50, with the core rod 50 and the inner sleeve 60 being spaced apart from one another by a predetermined distance to form the gap G. The inner sleeve 60 may abut an inner surface of the grout material 52 and, during fabrication of the buckling restrained brace 58", may provide for increased compaction and, possibly, strength of the grout material 52 as the same is introduced between the sleeve 51 and the inner sleeve 60. Additionally, the use of an inner sleeve 60 may provide for increased control over the dimensions of the effective gap between the core rod 50 and the grout material 52, thereby potentially improving fabrication quality of the buckling restrained brace 58".

FIGS. 17*a*–17*c* shows an embodiment of buckling restrained brace 58''' that includes each of the elements of any of buckling restrained braces 58, 58', and 58", except for the grout material 52. Instead, a rigid inner sleeve 61 concentrically surrounds the core rod 50, is spaced apart therefrom a predetermined distance to facilitate expansion of the thickness of the core rod 50 during compression thereof while preventing buckling of the core rod 50. In addition, the inner sleeve 61 is spaced apart from and maintained substantially centrally within the sleeve 51 by way of a plurality of circular plate washers 62 or other supports that may, by way of example only, be secured to the outer sleeve 51 or the outer surface of the inner sleeve 61. As shown, the plate washers 62 are spaced apart from one another along the length of the core rod 50 by an axial distance of L8.

As shown, the outer edges of the plate washers 62 are free to slide longitudinally along the inner surface of the outer sleeve 51 so that, during the final assembly of the bracing member, the fitted sub assembly comprising core rod 50, gussets 53 and 54, inner sleeve 61, and plate washers 62 may be slid into the outer sleeve 51.

In this configuration, the washers 62 and inner sleeve 61 together act as a buckling constraining element which prevents the core rod 50 from buckling over the distance L8. It is currently preferred that the Euler Buckling Load of the inner sleeve 61 over the distance L8 not be less than the Euler Buckling Load of the outer sleeve 51 over the full length of the buckling restrained brace 58'''.

As buckling restrained brace 58''' is formed only from steel parts and lacks any grout materials, it is easier to control the quality thereof and the weight of the buckling restrained brace 58''' is significantly reduced, which is a desirable feature for purposes of transportation and erection. Additionally, the overall weight of a frame that includes such a buckling restrained brace 58''' is reduced, which reduces earthquake-induced forces therein relative to grout-containing buckling restrained braces. Further, due to its steel construction, buckling restrained brace 58''' will incur little or no damage if it is dropped during transportation or erection.

Referring now to FIGS. 13*a*–13*c*, an exemplary manner of attaching a buckling restrained brace 58 (or buckling restrained brace 58', 58'', 58''' or other buckling restrained brace) that incorporates teachings of the present invention to a steel frame of a building or other structure is depicted.

As depicted in FIG. 13*a*, the steel frame includes beams 56 and columns 57, as well as buckling restrained braces 58, which are secured to the frame at junctions between the beams 56 and columns 57 by way of gusset plates that have, in turn, been secured (e.g., by welding) to the beams 56 and columns 57.

FIGS. 13*b* and 13*c* shows earthquake-generated lateral loads F1, F2 and F3 acting on the steel frame of FIG. 13*a* in the direction of the depicted arrows. When the lateral loads F1, F2, and F3 act in the direction shown in FIG. 13*c*, the core rod 50 (FIG. 12*a*) of the buckling restrained brace 58 is subjected to an axial compressive load and, thus, is in compression. The axial compressive load may be sufficient to cause the core rod 50 to buckle, but the grout 52 (FIG. 12*a*) and the sleeve 51 (FIG. 12*a*) of the buckling restrained brace 58 limit buckling of the core rod 50. As the sleeve 51 of the buckling restrained brace 58 is not itself secured to any part of the frame, the compressive load is substantially carried and, thus, resisted, the core rod 50.

As the core rod 50 is capable of entering a plastic state if the axial force exceeds its yield strength (e.g., during a severe earthquake), it is able to absorb considerable shock energy. Additionally, when the axial compressive load acts on the core rod 50, it shortens axially. Therefore, the length of the gap L7 between the plus section formed by gussets 53 and 54 (FIGS. 12*a*–12*g*) and the end of grout 52 diminishes when an axial compressive load is applied to the core rod 51. The length of the gap L7 should be designed such that, even during severe earthquakes, a small space remains between the inner ends of gussets 53 and 54 and the outer end of the grout material 52. If the gussets 53, 54 contact the grout material 52 during compression of the core rod 50, part of the axial force will be transferred to the grout material 52, which, in turn, will, by friction, transfer force to the sleeve 51, potentially resulting in premature failure of the buckling restrained brace 58, as the sleeve 51 is not designed for to directly resist any large axial loading.

When the vector of the axial load reverses, as shown in FIG. 13*c*, due to the cyclic nature of seismic loading, the buckling restrained brace 58 will subjected to a tensile force. The core rod 52 of the bracing member will now be subjected to tension and, thus, the length thereof will increase, or stretch. As with the application of a compressive load to the core rod 50, in tension, the core rod 50 can enter a plastic state and absorb considerable shock energy. The length of the gap L7 will likewise increase as the tension in the core rod 50 continues to increase. It is currently preferred that, even under a severe earthquake, at least a portion of the lengths of gussets 53, 54 and, thus, a portion of the plus section formed thereby, will remain within the sleeve 51 as the core rod 50 stretches. Thus, the sleeve 51 may act as a guide for concentric sliding of the plus section therein.

A buckling restrained brace 58 according to the present invention is capable of resisting the induced secondary moments and lateral shear forces caused by the normal fabrication deviations in geometry. Under ideal conditions, the centerlines of buckling restrained brace 58, an adjacent beam 56, and an adjacent column 57 would meet at a point P, as shown in FIG. 14*a*. But this may not be so in actual practice for many reasons, including, but not limited to, dimensional distortions of the beam 56 or column 57 during fabrication and nonlinearity (e.g., due to rolling tolerances) of the beam 56, column 57, or buckling restrained brace 58. Generally, it is very difficult to fabricate a steel structure with absolute dimensional accuracy. Code of practice in all countries permits certain allowable dimensional deviations in rolling of steel sections and in fabrication. The above deviations in the geometries of one or both of the beam 56 and column 57 will cause shears and bending moments in the buckling restrained brace 58.

In FIG. 14*b*, F4 represents the axial compressive load acting on the core rod 50 (FIG. 12*a*) of the buckling restrained brace 58 with an eccentricity of "e3" relative to the centerline of the buckling restrained brace 58. M3 represents the bending moment acting on the. buckling restrained brace 58. This bending moment is equal to the product F4×e. M4 represents the secondary moment acting on the buckling restrained brace 58 due to the rigidity of the end connections of the buckling restrained brace 58 to the beam 56 and column 57. Q represents the lateral force acting on the buckling restrained brace 58. In the present invention, these bending moments and lateral force Q will be resisted by the sleeve 51 (FIG. 12*a*) as reactions R. This is because a portion of the plus section, formed by gussets 53 and 53 (FIG. 12*a*), remains within the sleeve 51 and, thus, bending and lateral forces that are applied thereto will be transferred to the sleeve 51. Thus, bending of the plus section under such bending or lateral forces may be minimized or even reduced. Nonetheless, the plus section remains free to slide longitudinally inside the sleeve 51 and, therefore, little or none of the axial loading of the core rod 50 will be transferred to the sleeve 51. Therefore, the buckling restrained brace 58 of the present invention will better resist local bending, as shown in FIG. 11*b* in reference to the buckling restrained brace of Nippon Steel Company.

While determining the maximum force in a buckling restrained brace 58 (see, e.g., FIG. 12*a*) according to the present invention, not only should earthquake-induced loads on the frame be considered, but also other loads exerted thereon, such as dead load, live load, wind load, other specified loads, and combinations thereof.

A dynamic analysis of an entire frame design that incorporates buckling restrained brace 58 (FIG. 12*a*) technology according to the present invention may be carried out (e.g., with a computer) to determine the frequency of the frame design, response of the frame design to vibratory earthquake-generated forces, and to calculate lateral drift of the frame design when particular loads are applied thereto. By choosing proper sections for the beams, columns, core rods and sleeves, an extremely safe building may be designed.

In view of the design and configuration thereof, buckling restrained braces 58 of the present invention control of lateral drift of the frame of a structure (e.g., a building) that includes the buckling restrained braces 58, facilitating its usefulness in tall structures. Moreover, as the sleeve 51 of the buckling restrained brace 58 is not directly or rigidly secured to the frame, it does not increase the stiffness of the frame.

The repair of a buckling restrained bracing system according to the present invention is relatively simple. If a buckling restrained brace 58 becomes damaged by seismic loading thereof or otherwise, the buckling restrained brace 58 may be readily removed from a frame and a replacement buckling restrained brace 58 placed thereon.

What is claimed is:

1. A buckling restrained brace, comprising:

an elongate yielding core;

a hollow sleeve surrounding at least a portion of a length of said yielding core;

a buckling constraining element disposed within said hollow sleeve, said buckling constraining element surrounding at least a portion of said length of said yielding core and spaced apart from at least one surface thereof by a gaseous gap therebetween;

a liner positioned between said buckling constraining element and at least one surface of said yielding core and spaced apart from said at least one surface; and coupling elements at ends of said yielding core and protruding at least partially from ends of said hollow sleeve.

2. The buckling restrained brace of claim 1, wherein a cross-sectional shape of said yielding core, taken transverse to a length thereof, is round.

3. The buckling restrained brace of claim 1, wherein a cross-sectional shape of said yielding core, taken transverse to a length thereof, is rectangular.

4. The buckling restrained brace of claim 1, wherein said yielding core comprises steel.

5. The buckling restrained brace of claim 1, wherein said hollow sleeve comprises steel.

6. The buckling restrained brace of claim 1, wherein said buckling constraining element comprises a buckling constraining material.

7. The buckling restrained brace of claim 6, wherein said buckling constraining material comprises a grout.

8. The buckling restrained brace of claim 7, wherein said buckling constraining material comprises a concrete.

9. The buckling restrained brace of claim 1, wherein said buckling constraining element comprises:

an inner sleeve positioned between said yielding core and said hollow sleeve so as to substantially surround said yielding core; and a plurality of supports positioned between said hollow sleeve and said inner sleeve and spaced apart along a length of said inner sleeve for substantially maintaining a position of said inner sleeve within said hollow sleeve.

10. The buckling restrained brace of claim 1, wherein said buckling constraining element is spaced apart from at least two surfaces of said yielding core.

11. The buckling restrained brace of claim 10, wherein said buckling constraining element completely surrounds said yielding core.

12. The buckling restrained brace of claim 1, wherein said liner contacts said buckling constraining element.

13. The buckling restrained brace of claim 1, wherein a portion of each coupling element remains at least partially laterally surrounded by said hollow sleeve when a maximum tensile load is applied to said yielding core.

14. The buckling restrained brace of claim 1, wherein said buckling constraining element extends only partially along a length of said hollow sleeve.

15. The buckling restrained brace of claim 14, wherein an inner end of each coupling element and an adjacent end of said buckling constraining element are spaced apart a sufficient distance that, upon maximum compression of said yielding core, said inner end of each coupling element will not contact said adjacent end of said buckling constraining element.

16. The buckling restrained brace of claim 1, further comprising a lateral support element at each end of said yielding core, adjacent a corresponding coupling element.

17. The buckling restrained brace of claim 16, wherein said lateral support element comprises at least one washer through which said yielding core extends.

18. The buckling restrained brace of claim 17, wherein said lateral support element further comprises a spring on each side of and abutting said at least one washer, said yielding core also extending through each said spring.

19. The buckling restrained brace of claim 18, wherein said lateral support element further comprises a plate at an opposite side of each said spring, a first plate being positioned at an end of said buckling constraining element and a second plate being positioned at an inner end of an adjacent coupling element.

20. A method for manufacturing a buckling restrained brace, comprising:

assembling a yielding core and a hollow sleeve, said yielding core and said hollow sleeve comprising elongate members with said yielding core extending substantially through a length of said hollow sleeve;

positioning at least one spacer element adjacent to at least one surface of said yielding core;

introducing a buckling constraining element into said hollow sleeve, between an inner surface thereof and said yielding core;

permitting said buckling constraining material to at least partially harden; and removing said at least one spacer element, a gaseous gap remaining between said at least one surface and said buckling constraining element.

21. The method of claim 20, wherein said positioning said at least one spacer element comprises providing said at least one spacer element adjacent to a plurality of surfaces of said yielding core.

22. The method of claim 20, further comprising:

coating at least one surface of said at least one spacer element with a release agent.

23. The method of claim 20, wherein said positioning said at least one spacer element comprises providing at least one pair of superimposed spacers.

24. The method of claim 23, wherein said removing comprises removing one spacer of said at least one pair, the other spacer of said at least one pair remaining within said hollow sleeve, in contact with said buckling constraining element.

25. The method of claim 23, wherein said introducing said buckling constraining material comprises introducing a grout.

26. The method of claim 25, wherein said introducing said grout comprises introducing a concrete.

27. The method of claim 20, wherein said introducing said buckling constraining material comprises introducing an inner sleeve having a plurality of supports secured thereto and radially protruding therefrom between said yielding core and said hollow sleeve.

28. A method for seismically bracing a steel frame, comprising:

securing a coupling element at each end of a buckling restrained brace to a structural element of the steel frame, said buckling restrained brace comprising:

an elongate yielding core;

a hollow sleeve surrounding at least a portion of a length of said yielding core;

a buckling constraining element disposed within said hollow sleeve, surrounding at least a portion of said length of said yielding core, and spaced apart from at least one surface thereof by a gaseous gap therebetween; and coupling elements at ends of said yielding core and protruding at least partially from ends of said hollow sleeve;

absorbing an axial compressive load applied to an end of said yielding core, causing said yielding core to expand and reducing a distance between at least a portion of at least one surface of said yielding core and an inner surface of said buckling constraining element.

29. The method of claim 28, wherein, upon said absorbing said axial compressive load, said buckling constraining element prevents buckling of said yielding core.

30. The method of claim 28, further comprising:

absorbing tension applied axially to said yielding core.

31. The method of claim 30, wherein, upon said absorbing, a thickness of said yielding core decreases, increasing a distance between at least a portion of at least one surface of said yielding core and an inner surface of said buckling constraining element.

32. A buckling restrained brace, comprising:

an elongate yielding core;

a hollow sleeve surrounding at least a portion of a length of said yielding core;

a buckling constraining element disposed within said hollow sleeve, said buckling constraining element surrounding at least a portion of said length of said yielding core and spaced apart from at least one surface thereof by a gaseous gap therebetween;

a coupling element at each end of said yielding core and protruding at least partially from a corresponding end of said hollow sleeve; and a lateral support element comprising at least one washer at each end of said yielding core, adjacent a corresponding coupling element, said end of said yielding core extending through said at least one washer.

33. The buckling restrained brace of claim 32, wherein a cross-sectional shape of said yielding core, taken transverse to a length thereof, is round.

34. The buckling restrained brace of claim 32, wherein a cross-sectional shape of said yielding core, taken transverse to a length thereof, is rectangular.

35. The buckling restrained brace of claim 32, wherein said yielding core comprises steel.

36. The buckling restrained brace of claim 32, wherein said hollow sleeve comprises steel.

37. The buckling restrained brace of claim 32, wherein said buckling constraining element comprises a buckling constraining material.

38. The buckling restrained brace of claim 37, wherein said buckling constraining material comprises a grout.

39. The buckling restrained brace of claim 38, wherein said buckling constraining material comprises a concrete.

40. The buckling restrained brace of claim 32, wherein a portion of each coupling element remains at least partially laterally surrounded by said hollow sleeve when a maximum tensile load is applied to said yielding core.

41. The buckling restrained brace of claim 32, wherein said buckling constraining element extends only partially along a length of said hollow sleeve.

42. The buckling restrained brace of claim 41, wherein an inner end of each coupling element and an adjacent end of said buckling constraining element are spaced apart a sufficient distance that, upon maximum compression of said yielding core, said inner end of each coupling element will not contact said adjacent end of said buckling constraining element.

43. The buckling restrained brace of claim 32, wherein said lateral support element further comprises a spring on each side of and abutting said at least one washer, said yielding core also extending through each said spring.

44. The buckling restrained brace of claim 43, wherein said lateral support element further comprises a plate at an opposite side of each said spring, a first plate being positioned at an end of said buckling constraining element and a second plate being positioned at an inner end of an adjacent coupling element.

45. A method for seismically bracing a steel frame, comprising:

securing a coupling element at each end of a buckling restrained brace to a structural element of the steel frame, said buckling restrained brace comprising:

an elongate yielding core;

a hollow sleeve surrounding at least a portion of a length of said yielding core;

a buckling constraining element disposed within said hollow sleeve, surrounding at least a portion of said length of said yielding core, and spaced apart from at least one surface thereof by a gaseous gap therebetween; and coupling elements at ends of said yielding core and protruding at least partially from ends of said hollow sleeve; and absorbing tension applied axially to said yielding core, causing a thickness of said yielding core to decrease and a distance between at least a portion of at least one surface of said yielding core and an inner surface of said buckling constraining element to increase.

* * * * *